US005678429A

United States Patent [19]

Zonco

[11] Patent Number: 5,678,429

[45] Date of Patent: Oct. 21, 1997

[54] MACHINE FOR THE WET AND DRY TREATMENT OF FABRICS IN ROPE OR OPEN-WIDTH FORM

[75] Inventor: Maurizio Zonco, Coggiola, Italy

[73] Assignee: Zonco Federico & Figlio S.n.c., Pray Biellese, Italy

[21] Appl. No.: 587,487

[22] Filed: Jan. 17, 1996

[30] Foreign Application Priority Data

Jan. 19, 1995 [IT] Italy ..... MI95A0078

[51] Int. Cl.[6] ..... D06B 1/02; D06B 15/09

[52] U.S. Cl. ..... 68/20; 26/21; 34/633; 68/177; 68/205 R

[58] Field of Search ..... 68/20, 62, 177, 68/178, 205 R; 26/21; 226/97, 118; 34/633, 639, 640, 643, 487

[56] References Cited

U.S. PATENT DOCUMENTS

| | | | |
|---|---|---|---|
| 5,243,840 | 9/1993 | Grafen et al. | 68/178 X |
| 5,261,146 | 11/1993 | Belliot | 226/97 X |

FOREIGN PATENT DOCUMENTS

| | | | |
|---|---|---|---|
| 0215745 | 3/1987 | European Pat. Off. . | |
| 2489857 | 3/1982 | France . | |
| 2619834 | 3/1989 | France . | |
| 2602602 | 7/1977 | Germany . | |
| 2910485 | 9/1980 | Germany | 68/177 |
| 1131740 | 6/1986 | Italy . | |
| 1187084 | 12/1987 | Italy . | |
| 2081322 | 2/1982 | United Kingdom . | |

*Primary Examiner*—Philip R. Coe

*Attorney, Agent, or Firm*—Jacobson, Price, Holman & Stern, PLLC

[57] ABSTRACT

A machine for the wet and dry treatment of fabric in rope or open-width form of any type and weight has a treatment tank (10) within which the fabric to be treated is conveyed by a belt conveyor (11). The belt conveyor has an upper active conveying branch (15) and a lower return branch (16). The upper branch (15) of the conveyor is surrounded by an air transporter channel (22) with open ends and into which, in the vicinity of its entry end, a compressed air stream is fed to compress the fabric against the conveyor belt without the intervention of mechanical compression means the machine prevents the formation of creases in the fabric and allows treatment at a high effective rate.

8 Claims, 2 Drawing Sheets

MACHINE FOR THE WET AND DRY TREATMENT OF FABRICS IN ROPE OR OPEN-WIDTH FORM

BACKGROUND OF THE INVENTION

1. Field of the Invention

This invention relates to a machine for the wet and dry treatment of fabrics in rope or open-width form, such as scouring, fulling or other treatment.

2. Description of the Related Art

Fabrics for treatment by the machine of the invention can be woollen, cotton, silk, synthetic or mixed of any type and weight (light, heavy or medium weight).

Machines of this type have been known for some time and traditionally comprise within a treatment tank two superposed cooperating rollers pressed elastically one against another to draw the fabric from the bottom of the tank and feed it so that it strikes an opposing fulling plate or feed it to a fulling channel (fulling box), from the exit of which the fabric again falls onto the bottom of the tank, to be again taken up in endless-loop form by the two rollers.

One of the main drawbacks of this type of machine, especially in treating fabrics in rope form, is the formation of creases, abrasion or strike marks in the fabric, due to the continuous jerking of the upper roller and the repeated passage of the same fabric region between the two presser feed rollers. To partially obviate this drawback it has been proposed to sew the fabric into a tube or bag, selvedge against selvedge, leading to a certain inflation of the interior of the fabric tube with air due to centrifugal force, with consequent smoothing of the fabric and of its creases, so that different fabric regions pass in succession between the two rollers. However this preliminary bag sewing and the subsequent unsewing result in a considerably increased labour cost, so that it becomes preferable not to do it.

One proposal for preventing damage to fabric in rope form during treatment, preferably without having to firstly sew the fabric into a bag (see Italian patent 1,131,740), consists of passing the fabric in rope form between a rotating roller and an air chamber opposing the roller. As the fabric in rope form is now no longer squeezed between two rigid bodies (two rollers) for its transport, but instead is subjected to the preferably adjustable pressing action which the air chamber exerts on the fabric passing over the rotating roller, the formation of permanent creases and strike marks in the fabric should be considerably reduced, even though it is not possible to totally eliminate them. Hence in many cases, even in a machine based on this latter proposal, the fabric has still to be firstly sewn into bag form, especially in the case of the more delicate fabrics.

According to a later proposal (see Italian patent 1,187,084) the fabric in rope form is transported and projected against the opposing fulling plate by a transporting air stream, however two cooperating presser rollers are still required for drawing the fabric from the bottom of the tank and feeding it into an entrainment duct within which the air stream acts, as the dragging force provided by the air stream alone is insufficient especially for heavy and/or wet fabrics. Hence this proposal has also not succeeded in totally eliminating the problem of creases and strike marks in treated fabrics without them being initially sewn into bag form, this proposal being usable mainly for treating light fabrics, as the dragging effect on heavy fabrics by the air stream has proved unsatisfactory.

SUMMARY OF THE INVENTION

The main object of the present invention is to provide a machine for the wet and dry treatment of fabrics in rope or open-width form of any type and weight, in which fabric damage such as crease or strike mark formation is prevented to the maximum extent without the need to initially sew the treated fabric into bag form, and with the ability to achieve an effective treatment rate considerably greater than that currently attainable by machines of this type, especially in the case of heavy or medium weight fabrics.

This object is attained by a machine comprising a treatment tank containing, for the fabric in endless-loop form to be treated, a belt conveyor orientated towards an opposing fulling plate, said belt conveyor having an active upper conveying branch and a lower return branch, the upper conveying branch being surrounded by a transporter channel with its entry and exit ends open, into which channel, in the vicinity of its exit end, there opening a duct for feeding a compressed air stream onto the upper branch of the belt conveyor which passes longitudinally through said transporter channel, the air stream fed by said duct into said channel having a flow component orientated in the direction in which the upper branch of the conveyor advances through the channel and a component normal to said conveyor upper branch, so as to exert a pneumatic pressure on the fabric conveyed by the conveyor.

With a machine of this conception the fabric is conveyed by the upper branch of the belt conveyor, against which it is pressed only by the pneumatic force of the compressed air stream fed into the transporter channel surrounding said conveyor upper branch, and without the intervention of any mechanical pressing means, so that crease or strike mark formation in the fabric is effectively avoided without it being necessary to previously sew the fabric into bag form, while being able to reach a very high fabric advancement rate and also being able to treat fabrics from medium to heavy weight. The attainable advancement rate reaches 700–800 m/min and beyond.

The belt of the conveyor can be in the form of a normal conveyor belt, for example of rubber or rubber-coated, smooth or toothed, the belt being impermeable to air and passing at the ends of its upper and lower branches about two respective return rollers, one of which is motorized.

At the commencement of the active upper branch of the conveyor coinciding with the entry end of the channel surrounding said active branch, a lead-in can be provided to facilitate the entry of the fabric drawn up from the bottom of the treatment tank. The belt conveyor with the relative air transporter channel surrounding its upper branch can be used either for a single endless loop of fabric or for more than one loop. In practice, a plurality of belt conveyors and relative compressed air transporter channels can be positioned side by side within the treatment tank.

Each of these transporter channels has a constant rectangular cross-section from their entry to their exit, this cross-section being less than that of the air feed duct opening into the channel, so as to increase the speed of the air stream passing through the transporter channel.

The compressed air stream fed into the feed duct or ducts for the air transporter channel or channels is produced by a main fan either drawing atmospheric air from outside the treatment tank or drawing recycled air from the interior of the tank through a filter-compactor. The delivery air from said main fan can pass through a heat exchanger to be heated before being fed into said feed duct or ducts. If atmospheric air is drawn from the outside, a corresponding quantity of air is drawn from the tank interior by an auxiliary second fan, to be expelled to the outside after filtration through a filter-compactor.

The base of each air transporter channel is slightly spaced opportunely from the lower surface of the active upper branch of the belt conveyor passing through it so that a fraction of the air fed into the air transporter channel is also made to pass below the belt conveyor. Said base can also be suitably removable to enable the belt of the conveyor to be replaced when necessary. The air fraction passing between the belt of the conveyor and the base of the transporter channel prevents possible entanglement of the conveyed fabric at the channel exit. Further details of the machine according to the invention will be more apparent from the description of an embodiment of a machine for the treatment of fabrics in rope form given hereinafter by way of non-limiting example with reference to the accompanying drawings.

DETAILED DESCRIPTION OF THE PREFERRED EMBODIMENTS

Figure 1:
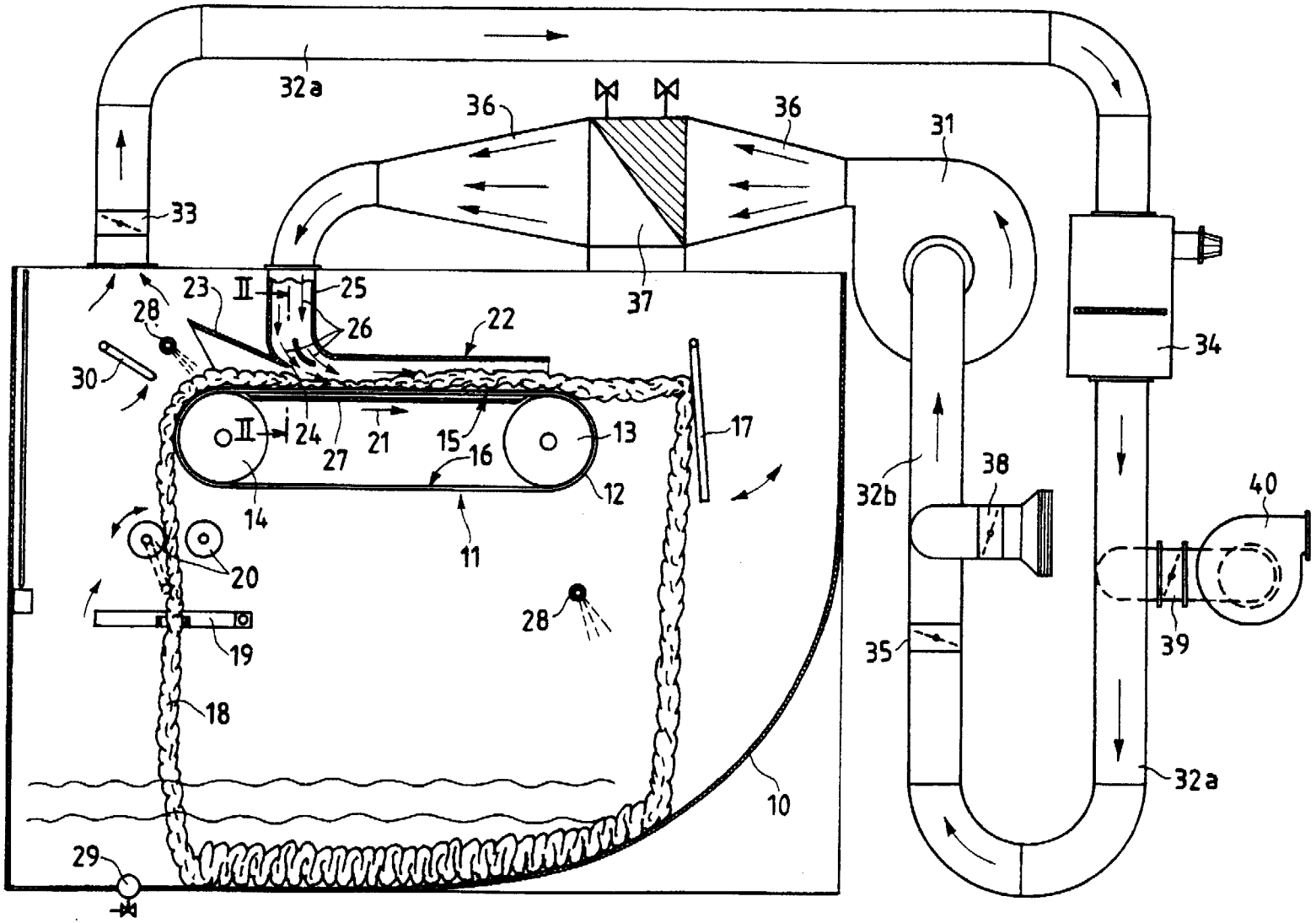
FIG. 1 is a schematic vertical section through the machine.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

As shown in FIG. 1, a tank 10 of traditional form contains in the upper part of its interior a belt conveyor 11, the endless belt 12 of which passes about two return rollers 13, 14, of which one is motorized, so as to define an upper active conveying branch 15 and a lower return branch 16. The upper branch 15 of the conveyor 11 is orientated towards an opposing fulling plate 17. By means of the belt conveyor 11, the fabric in rope form 18, extending as an endless loop, is drawn from the base of the tank 10, and after passing through a separator 19 for separating the ropes (in this respect, several fabric pieces in endless rope form are normally treated in parallel in the machine) and possibly through a pair of presser rollers 20 (of which one is movable), is deposited on the upper branch 15 of the conveyor 11 at its return roller 14, to be conveyed in the direction of advancement (arrow 21) of the branch 15, and be finally projected against the opposing fulling plate 17, from which it falls onto the bottom of the tank 10. To enable the fabric in rope form to be effectively dragged at high speed by the upper branch 15 of the belt conveyor according to the invention there is provided an air transporter channel 22 which surrounds said upper branch 15 of the conveyor and has its entry and exit ends open. At its entry end (to the left in FIG. 1), the channel 22 upperly comprises a lead-in 23 to facilitate the entry of the fabric 18, this being followed by the mouth 24 of a compressed air feed duct 25. As can be clearly seen in FIG. 1, the mouth 24 of the duct 25 is curved to give the air stream leaving the duct 25 and entering the channel 22 (in accordance with the arrows 26) both a component orientated in the direction of advancement (arrow 21) of the branch 15 of the conveyor 11, which passes longitudinally through the channel 22, and a component normal to said branch 15 of the conveyor 11.

In this manner the compressed air fed into the channel 22 exerts on the fabric in rope form 48 resting on the belt 12 a pressure such as to ensure reliable dragging of the fabric 48 at a very high speed, even in the case of heavy fabric.

The transporter channel 22 has a constant rectangular cross-section from its entry to its exit, this cross-section being smaller than that of the air feed duct 25.

Figure 2:
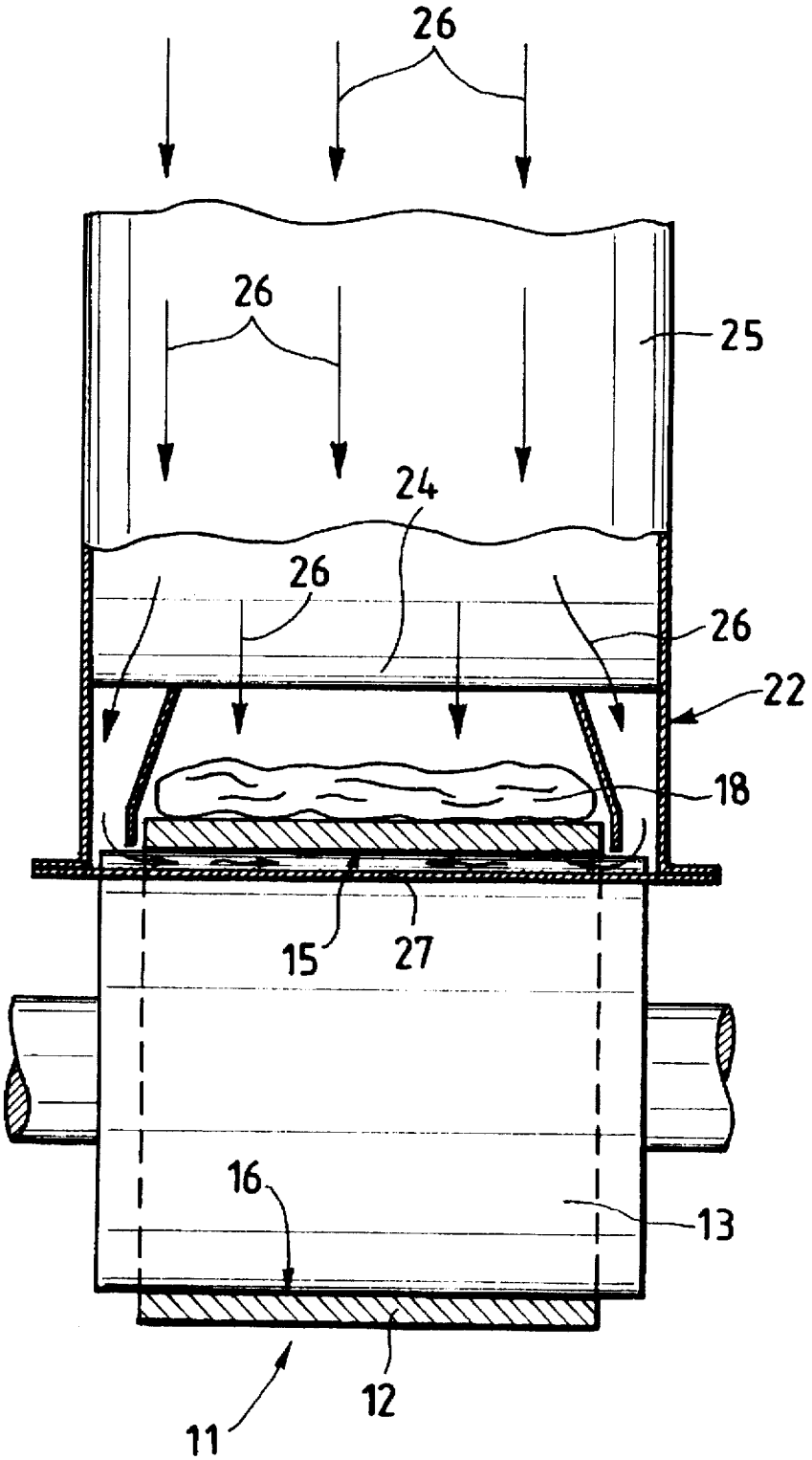
FIG. 2 is a cross-section through a detail on the line II—II of FIG. 1.

As can be clearly seen in FIG. 2, a fraction of the compressed air fed into the transporter channel 22 also reaches the interspace between the branch 15 of the conveyor 11 and the base 27 of the channel 22. This air fraction passing below the belt 12 prevents the conveyed fabric becoming tangled at the exit from the channel 22 and creating problems.

It should be noted that the base 27 of the transporter channel 22 is screwed and easily removable to allow the belt 12 of the conveyor 11 to be replaced when necessary. This belt can be a normal smooth or toothed rubber-coated or rubber belt, and is impermeable to air.

Spray nozzles 28 are provided in suitable positions within the tank 10 to wet the fabric with a treatment liquid, which collects on the base of the tank 10 and can be discharged through a base drain 29.

Before the entry to the transporter channel 22 there can be positioned a safety frame 30 sensitive to possible abnormal fabric accumulation in this region, to halt the machine.

To create the compressed air stream to be fed into the feed duct or ducts 25 to the transporter channel or channels 22 there is provided a main fan 21 positioned outside the tank 10. The intake duct, indicated overall by **32*a* and 32*b*, to the main fan 31 can be divided into two portions by a shut-off valve 35. The first portion 32*a* of this intake duct, upstream of the valve 35, is connected to the interior of the tank 10 via a regulator valve 33, a filter-compactor 34 being connected into this duct portion. The second portion 32*b* of the intake duct downstream of the valve 35, i.e. the portion close to the main fan 31, is connected to atmosphere via a branch carrying a regulator valve 38. The suction side of an auxiliary second fan 40, discharging to atmosphere, is connected via a further shut-off valve 39 to said first portion 32*a* of the intake duct downstream of the filter-compactor 34 but upstream of the shut-off valve 35**.

The machine can be operated according to two different operating cycles.

In a first operating cycle only the main fan 31 operates, the valve 35 is open and hence the two portions **32*a* and 32*b* of the intake duct to the main fan 39 freely communicate with each other, whereas the shut-off valve 39 is closed to hence close communication with the suction side of the auxiliary fan 40, which is not in operation. This cycle hence comprises a closed circuit in which the air circulates from the tank 10 and back to the tank. The air drawn from the tank 10 in variable quantity determined by the position of the regulator valve 33 is filtered through the filter compactor 34 which filters out and compacts the particles carried by the air from the tank. The air passes through the open valve 35 to the main fan 31 which via its delivery side 36 feeds it to the heat exchanger 37. This latter can be either operative or inoperative according to requirements. Finally the recirculated air reaches the feed duct or ducts 25 to the transporter channel or channels 22** to perform its already described function.

In the second operating cycle both the main fan 31 and the auxiliary fan 40 operate, the shut-off valve 35 is closed to separate the two portions **32*a* and 32*b* of the intake duct to the main fan, while the shut-off valve 39 is open to connect the suction side of the auxiliary fan 40 to the portion 32***a*. In this situation the auxiliary fan 40 draws air from the interior of the tank 10 in a variable quantity determined by the position of the regulator valve 33, this air being expelled to atmosphere after being filtered through the filter-compactor 34.

In contrast the main fan 31 draws air from atmosphere through the portion 32*b* of its intake duct in a variable quantity, determined by the position of the regulator valve 38, corresponding to the air quantity drawn from the tank interior and expelled to atmosphere by the auxiliary fan 40, and feeds this air through the heat exchanger 37 (operative or inoperative) and into the feed duct or ducts 25 to the transporter channel or channels 22. In this manner a certain quantity of air is withdrawn from the tank interior to be expelled to atmosphere and a corresponding quantity of atmospheric air is fed into the treatment tank, to maintain a constant air volume in the treatment tank.

In one practical example the air transporter channel 22 surrounding the active upper branch 15 of the conveyor 11 has a length of 1560 mm (being the distance between the axes of the return rollers 13, 14) with a uniform rectangular cross-section of 300×100 mm, the rectangular cross-section of the feed duct 25 being 300×240 mm. Air is fed to the transporter channel 22 at a rate of 4500 $m^3$/h, the air velocity at the exit from the duct 25 (cross-section 300×240 mm) being 17.36 m/sec, and the air velocity at the exit from the channel 22 (cross-section 300×100 mm) being 41.6 m/sec. The dynamic pressure at the entry to the channel 22 is 18.8 kg/$m^2$ and the pneumatic force acting on a fabric section assumed equivalent to the cross-section (300×240 mm) is 1.35 kg.

As stated, more than one belt conveyor 11 can be positioned side by side in the tank 10, each for one or more endless loops of fabric and each having its active upper branch 15 surrounded by its own air transporter channel 22, fed with compressed air by a duct 25.

The machine according to the invention has given excellent results in treating fabric of any type and weight, and in particular of medium and heavy weight, without the need to previously sew the fabric to be treated into bag form and with no formation of creases or strike marks in the treated fabric. The treatment rate is very high, with an advancement speed of fabric in rope form of the order of 700–800 m/min.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

I claim:

1. A machine for the wet and dry treatment of fabrics in rope or open-width form comprising a treatment tank internally containing means for conveying the fabric in the form of an endless loop such as to draw the fabric from the bottom of the tank and feed it to strike a fulling place and a spray nozzle for wetting the fabric, wherein said conveying means comprise at least one belt conveyor oriented towards said fulling plate, said conveyor having an active upper branch and a lower return branch, the upper branch of the conveyor being surrounded by a transporter channel having open entry and exit ends, into which channel, in the vicinity of its entry end, a duct opens for feeding a compressed air stream onto the upper branch of the belt conveyor which passes longitudinally through said transporter channel, the air stream fed by said duct into said channel having a flow component oriented in the direction in which the upper branch of the conveyor advances through the channel and a component normal to said conveyor upper branch, so as to exert a pneumatic pressure on the fabric conveyed by the conveyor.

2. A machine as claimed in claim 1, wherein the belt of the conveyor is an impermeable smooth or toothed rubber-coated or rubber belt.

3. A machine as claimed in claim 1, wherein the transporter channel has a rectangular cross-section which is constant from its entry end to its exit end, this cross-section being smaller than that of the air feed duct which opens into the channel.

4. A machine as claimed in claim 3, wherein the transporter channel has a base which is parallel to and spaced apart from a lower surface of the upper branch of the conveyor belt.

5. A machine as claimed in claim 4, wherein the base of the transporter channel is removable.

6. A machine as claimed in claim 1, further comprising a main fan positioned outside the treatment tank and arranged to either draw air from the atmosphere outside the treatment tank or draw recirculated air from the interior of the tank through a filter-compactor, and feed the drawn air under pressure into the feed duct to the transporter channel.

7. A machine as claimed in claim 6, wherein a heat exchanger is connected to the delivery side of the main fan.

8. A machine as claimed in claim 6, further comprising an auxiliary second fan arranged to draw air, as an alternative to the main fan, from the interior of the treatment tank and to feed this air to atmosphere after passing through the filter-compactor.

* * * * *